US012233989B2

(12) United States Patent
Godin et al.

(10) Patent No.: US 12,233,989 B2
(45) Date of Patent: Feb. 25, 2025

(54) FLUSH MOUNT DECK HATCH SEAL SYSTEM

(71) Applicants: Emile Earl Godin, Eelbrook (CA); Daniel Godin, Eelbrook (CA)

(72) Inventors: Emile Earl Godin, Eelbrook (CA); Daniel Godin, Eelbrook (CA)

( * ) Notice: Subject to any disclaimer, the term of this patent is extended or adjusted under 35 U.S.C. 154(b) by 471 days.

(21) Appl. No.: 17/857,109

(22) Filed: Jul. 4, 2022

(65) Prior Publication Data

US 2024/0002018 A1 Jan. 4, 2024

(51) Int. Cl.
*B63B 19/14* (2006.01)

(52) U.S. Cl.
CPC ..... *B63B 19/14* (2013.01)

(58) Field of Classification Search
CPC ..... B63B 19/00; B63B 19/12; B63B 19/14; B63B 19/24; B63B 2019/245; B63B 19/26
USPC ..... 114/55.53, 201, 203
See application file for complete search history.

(56) References Cited

U.S. PATENT DOCUMENTS 2,869,501 A * 1/1959 Stransky ..... B63B 19/26 160/40
3,827,784 A * 8/1974 Giglia ..... G02F 1/1524 359/275
5,676,082 A * 10/1997 Kyle ..... B63B 19/26 49/386
7,434,532 B2 * 10/2008 Kaneko ..... B63B 25/082 114/55.53
8,453,589 B2 * 6/2013 Czarnowski ..... B63B 19/14 114/201 R

* cited by examiner

*Primary Examiner* — Daniel V Venne
(74) *Attorney, Agent, or Firm* — CAPEHART LAW FIRM

(57) ABSTRACT

A hatch seal system for a hatch opening of a water vessel deck includes a frame, a gasket assembly and a hatch cover. Particularly, the gasket assembly is disposed within the frame and includes an elongate strip of metal material, such as a strip of wire mesh, and a synthetic rubber material surrounding the elongate strip of metal material. The gasket system, along with the hatch cover, provide a watertight seal that will not dislodge from the frame under extreme weather conditions, thereby providing longevity and preventing sinking of a vessel on which the flush mount deck hatch seal system is installed.

20 Claims, 14 Drawing Sheets

FLUSH MOUNT DECK HATCH SEAL SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of water vessel hatches of existing art and more specifically relates to an improved hatch seal system.

RELATED ART

A deck hatch is located in a deck of a water vessel, such as a boat, and generally defines a portal through which storage, cargo, living space, etc. is accessed via the deck of the water vessel. There are many crucial features that a deck hatch should include in order to function properly and maintain integrity of the water vessel; one of the most important of these features being a reliable seal. The seal is extremely critical in preventing water from travelling through the hatch and reaching areas below deck, which is particularly problematic for objects and areas that may be damaged by water.

However, there are many problems with current hatch seal systems in the art. For example, many existing systems utilize natural rubber for the seal, which is prone to rotting. Further, many existing systems utilize glue for adhering the seal to a frame of the hatch, which frequently results in the seal coming loose from the frame. This is particularly true in extreme weather conditions, where the seal freezes to the hatch cover and comes detached from the frame once the hatch cover is pried open. Again, this can lead to damage below the deck and potentially can result in sinking of the vessel if too much water is let through the hatch. As such, a suitable solution is desired.

SUMMARY OF THE INVENTION

In view of the foregoing disadvantages inherent in the known hatch cover art, the present disclosure provides a novel flush mount deck hatch seal system. The general purpose of the present disclosure, which will be described subsequently in greater detail, is to provide a watertight seal that will not dislodge from a hatch frame under extreme weather conditions, thereby providing longevity of the flush mount deck hatch seal system.

A hatch seal system for a hatch opening in a water vessel deck is disclosed herein. The hatch seal system may comprise a frame, a gasket assembly and a hatch cover. The frame may be configured to install into and border the hatch opening. The frame may include a flange portion contacting the water vessel deck when installed and extending substantially parallel thereto; and a cover receiving portion extending downwardly from the flange portion into the hatch when installed and substantially perpendicular to the water vessel deck. Further, the cover receiving portion may include a space and the gasket assembly may be disposed about a bottom of the space. The gasket assembly may include at least one elongate strip of metal material and a synthetic rubber material surrounding the at least one elongate strip of metal material.

The hatch cover may be configured to selectively cover the hatch opening. The hatch cover may include a top surface opposite a bottom surface and a peripheral lip extending downwardly from the top surface and substantially perpendicular to the top surface and the water vessel deck. The hatch cover may be movably attached to the frame such that the hatch cover is movable between a closed position and an open position, the closed position covering the hatch opening. The peripheral lip may be inserted into the space when in the closed position and an edge of the peripheral lip may be pressed into the synthetic rubber material, causing the synthetic rubber material to surround the edge of the peripheral lip and thereby creating a watertight seal for the hatch opening.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a flush mount deck hatch seal system, constructed and operative according to the teachings of the present disclosure.

The various embodiments of the present invention will hereinafter be described in conjunction with the appended drawings, wherein like designations denote like elements.

DETAILED DESCRIPTION

Figure 1:
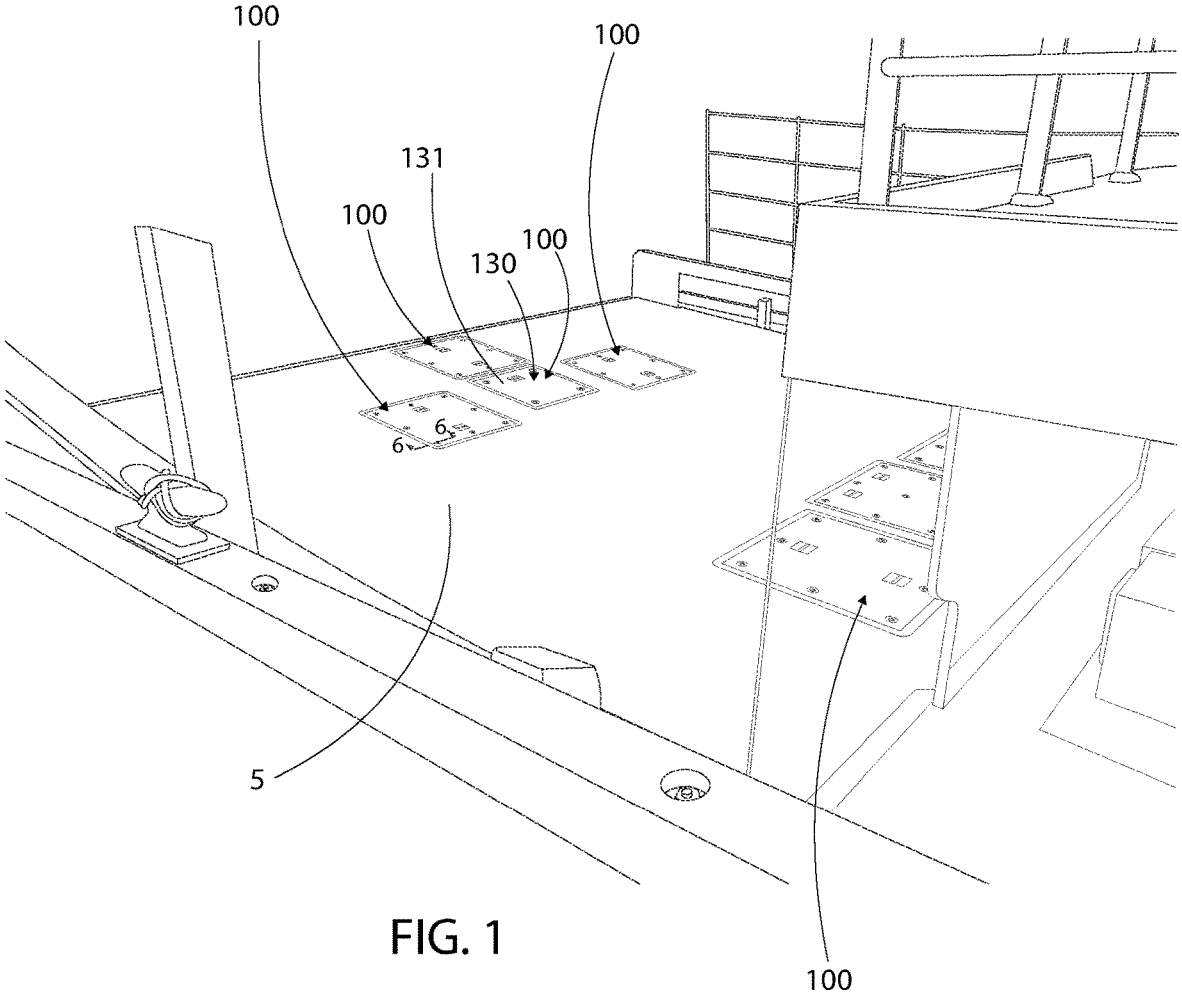
FIG. 1 is a side-rear perspective view of the hatch seal system installed into a deck of a water vessel and illustrating a hatch cover in a closed position mounted flush to the deck, according to an embodiment of the disclosure.

As discussed above, embodiments of the present disclosure relate to a hatch cover system and more particularly to a flush mount deck hatch seal system. Generally, the flush mount deck hatch seal system may include a frame rail having a gasket system disposed therein. The gasket system may include a strip of wire mesh and a synthetic rubber material surrounding the strip of wire mesh. The gasket system may provide a watertight seal that particularly withstands extreme weather conditions and other extraneous elements, such as fuel. This may prevent a vessel on which the hatch system is installed from sinking and may improve longevity.

Particularly, the flush mount deck hatch seal system may prevent commonly known problems associated with current hatch systems, such as freezing gaskets, rotting rubber, gaskets coming loose from the frame, etc. Thus, the flush mount deck hatch seal system provides peace of mind knowing that no unwanted water will escape below deck, especially into areas such as the engine room.

Referring now more specifically to the drawings by numerals of reference, there is shown in FIGS. 1-20, various views of a hatch seal system 100. As shown in these figures, the hatch seal system 100 may include a frame 110, a gasket assembly 120 and a hatch cover 130. As shown in particularly in FIG. 2 the hatch seal system 100 may be for a hatch opening 6, in a water vessel deck 5. Particularly, the hatch seal system 100 may provide an improved hatch seal system 100 for installation into the hatch opening 6, preventing common problems associated with current hatch systems, as discussed above. In some examples, the water vessel may be a commercial water vessel, such as for fisherman, fish farms and other marine professions.

Figure 2:
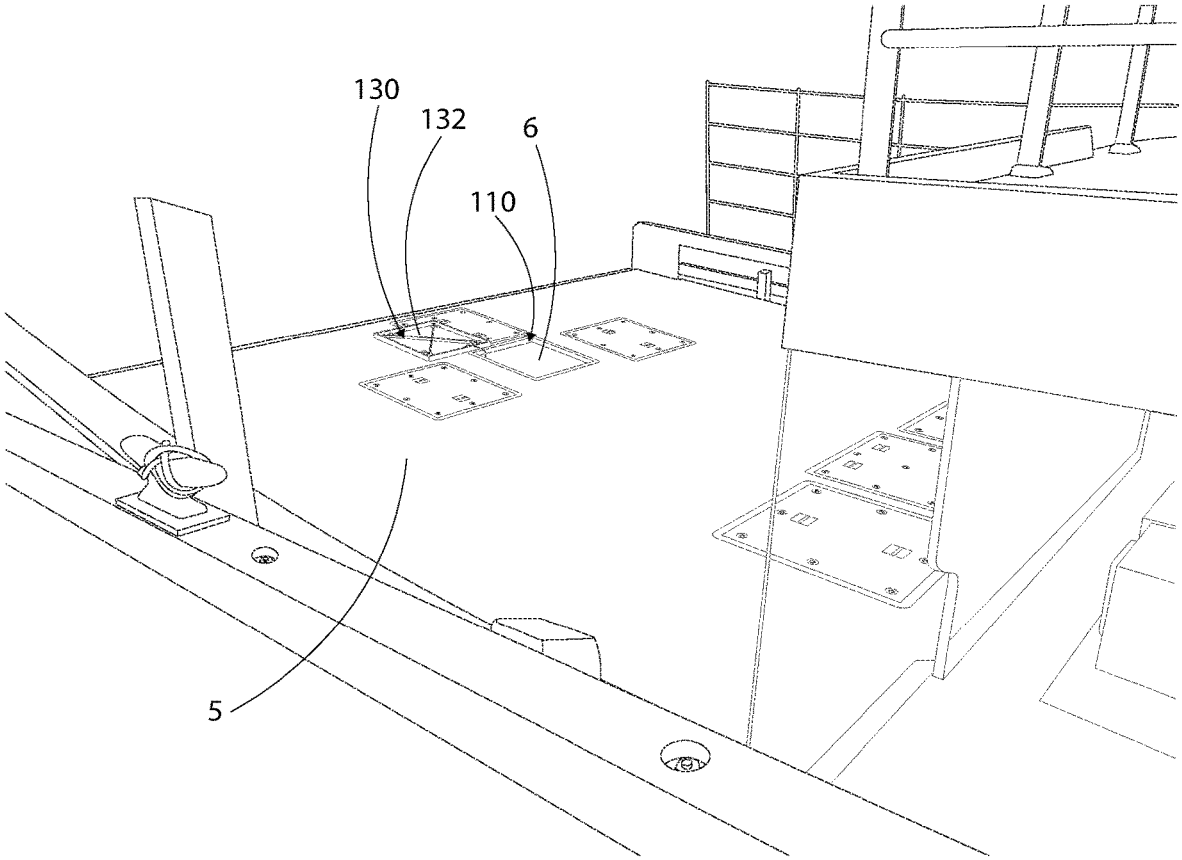
FIG. 2 is a side-rear perspective view of the hatch seal system of FIG. 1 illustrating the hatch cover in an open position, according to an embodiment of the present disclosure.
Figure 3:
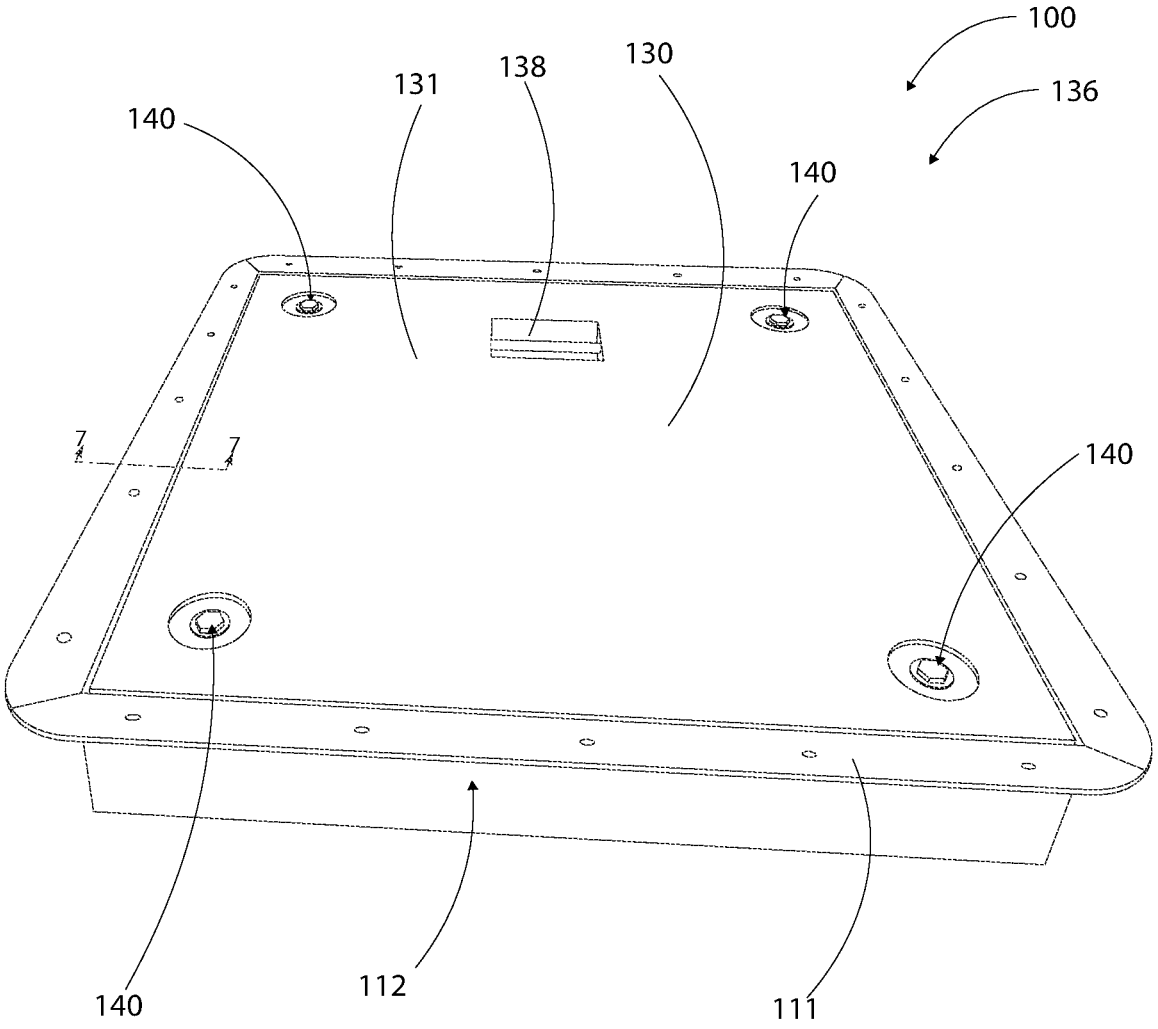
FIG. 3 is a front perspective view of the hatch seal system illustrating the hatch cover in the closed position, according to an embodiment of the present disclosure.
Figure 4:
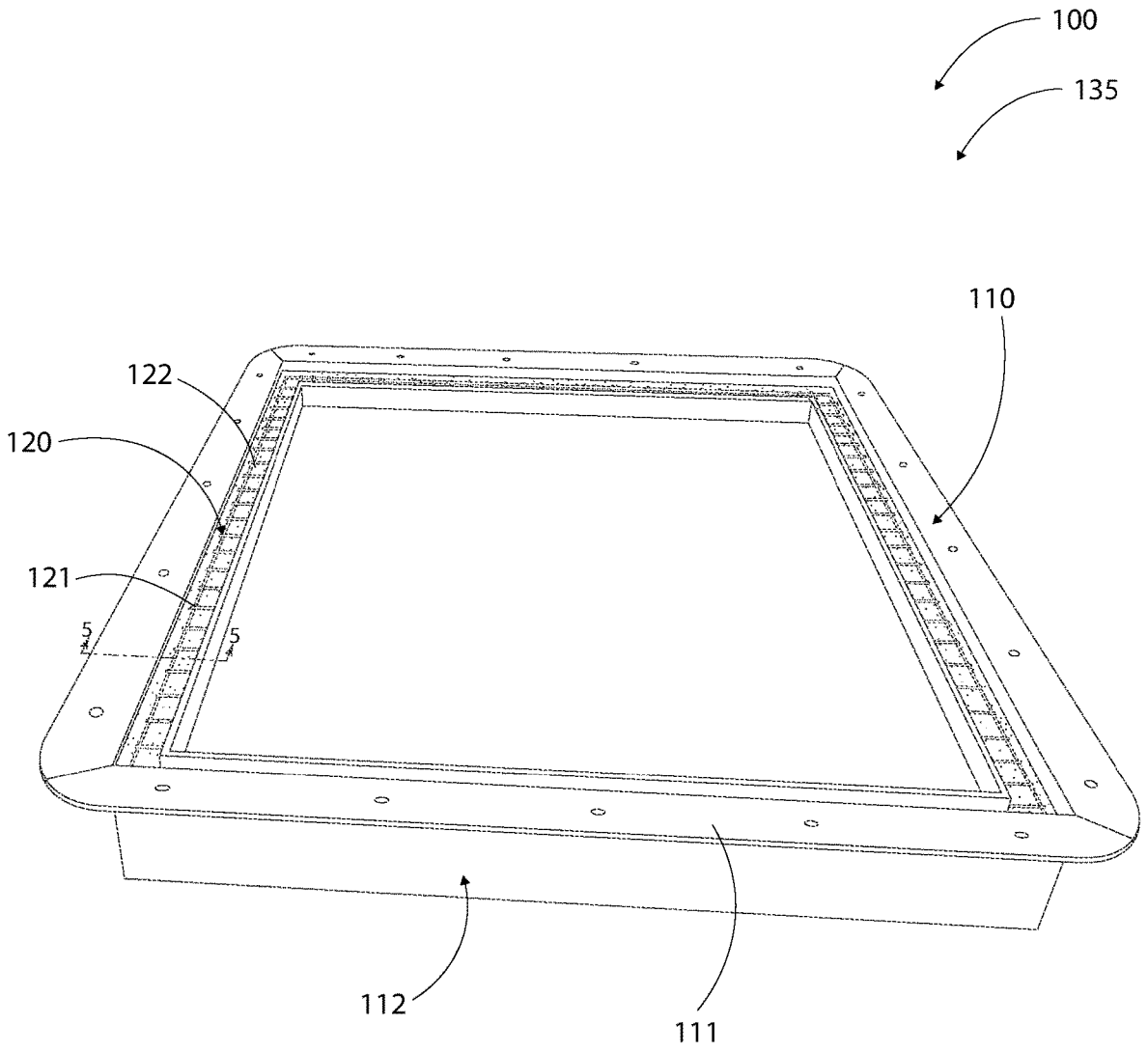
FIG. 4 is a front perspective view of the hatch seal system illustrating the hatch cover in the open position and a frame having a gasket assembly disposed therein, according to an embodiment of the present disclosure.
Figure 5:
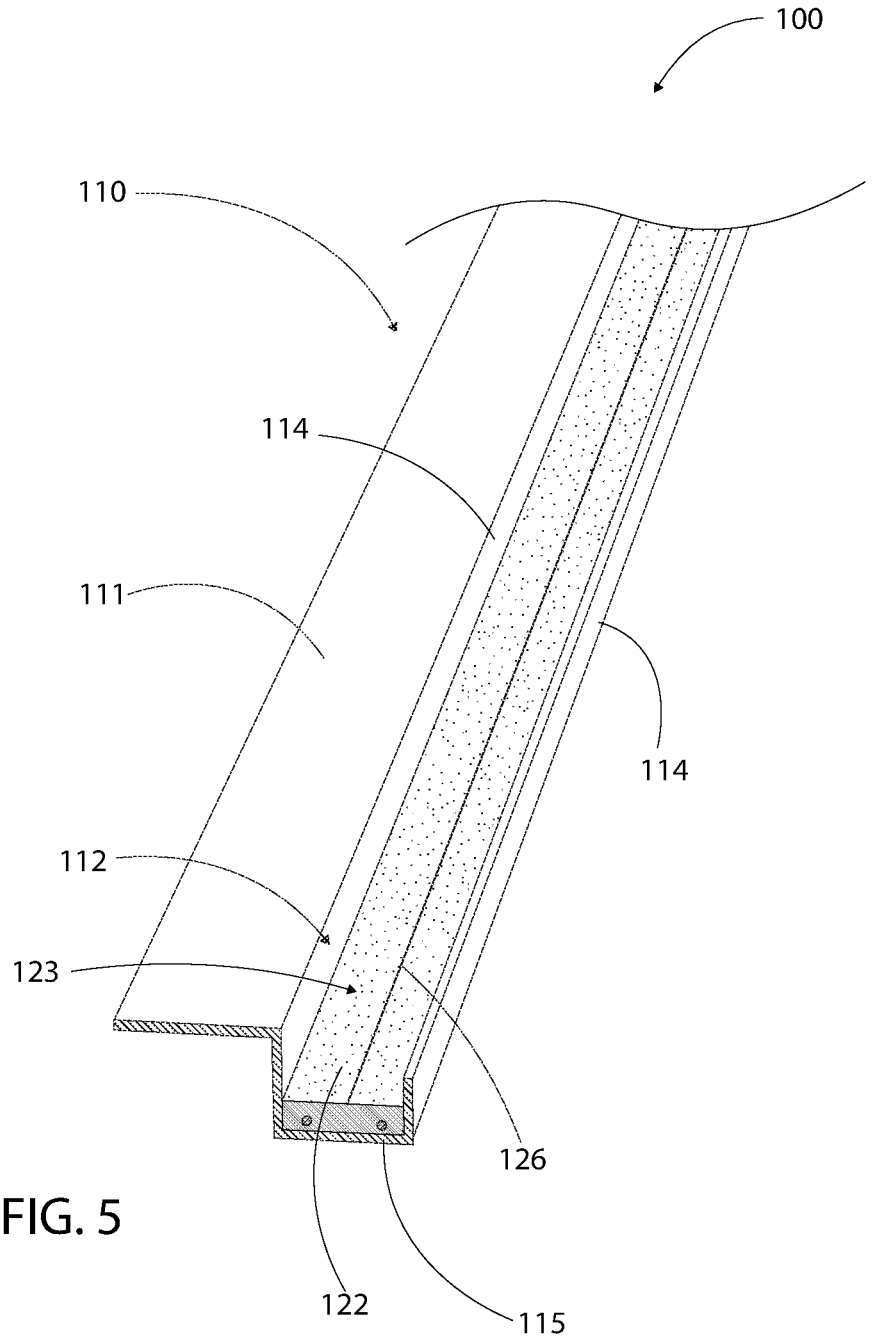
FIG. 5 is a cross-sectional front perspective close-up view of the hatch seal system taken from line 5-5 in FIG. 4 and illustrating the gasket assembly including a synthetic rubber material surrounding an elongate strip of metal material, according to an embodiment of the present disclosure.

As shown in FIGS. 1-2, the frame 110 may be configured to install into and border the hatch opening 6. As such, the frame 110 may be shaped and sized similar to that of the hatch opening 6. For example, as shown in these figures, the frame 110 may include a generally square shape (with rounded edges). The frame 110 may be defined by a frame rail. In some embodiments, as shown in these figures, the frame rail may be one continuous piece; in other embodiments, the frame rail may be made up of four frame rails (one for each side of the frame 110).

As shown in FIGS. 3-10, the frame 110 may include a flange portion 111 and a cover receiving portion 112. In some embodiments, as shown in these figures, the frame 110 may be formed as one piece. For example, the frame 110 may be molded from one piece of material, fused or welded together, etc. The frame 110 may be made from a rigid and durable material that is able to withstand repeated water exposure. For example, in some embodiments, the frame 110 may be made from, or at least comprise, (but is not limited to) a stainless steel material.

As shown in FIGS. 1-2, the flange portion 111 may be configured to contact the water vessel deck 5 when installed thereinto and as shown, may extend substantially parallel thereto, creating a supportive and sturdy connection between the frame 110 and the water vessel deck 5. To enable a durable installation, the flange portion 111 may be screwed or bolted onto the water vessel deck 5. Further, as shown, the cover receiving portion 112 may extend downwardly from the flange portion 111 into the hatch opening 6 (when installed) and may be, at least substantially, perpendicular to the water vessel deck 5.

The cover receiving portion 112 may include a generally U-shaped cross-section 113. Particularly, the cover receiving portion 112 may include a pair of side panels 114 and a cross-panel 115 attached therebetween. A first side panel 1141 from the pair of side panels 114 may be attached to and extend downwardly and perpendicular to the flange portion 120. The first side panel 1141 may abut a side of the hatch opening 6. The cross-panel 115 may be attached in between the pair of side panels 114. Particularly, the cross-panel 115 may be attached to and extend substantially perpendicular from a bottom end of the first side panel 1141, and a second side panel 1142 from the pair of side panels 114 may be attached to and extending upwardly and perpendicular to the cross-panel 115 (parallel to the first side panel 1142). As shown, the second side panel 1142 may include a shorter length than the first side panel 1141. Further, a space 118 (FIG. 7) may be defined between the pair of side panels 114 and the cross-panel 115 may define a bottom of the space 118.

The hatch cover 130 may be configured to selectively cover the hatch opening 6. As such, the hatch cover 130 may be movably attached to the frame 110 such that the hatch cover 130 is movable between a closed position 136 (wherein the hatch cover 130 covers the hatch opening 6) and an open position 135 (wherein the hatch cover 130 uncovers the hatch opening 6 and the hatch opening 6 is accessible). As shown in FIG. 2 particularly, the hatch cover 130 may be completely removable from the frame 110. In this embodiment, the hatch cover 130 may be tethered to the frame 110 so that the hatch cover 130 does not fall from the water vessel. To aid in removal of the hatch cover 130 from the hatch opening 6, as shown in FIG. 3 and FIGS. 12-20, the hatch cover 130 may include at least one handle 138. Preferably, the at least one handle 138 may be designed to sit at least flush or lower than a top surface 131 of the hatch cover 130, and thus, flush (or lower than) the water vessel deck 5 when in the closed position 136.

The hatch cover 130 may include the top surface 131 opposite a bottom surface 132 and a peripheral lip 133 extending downwardly from the top surface 131 and substantially perpendicular to the top surface 131 and the water vessel deck 5. In some embodiments, the hatch cover 130 may be made from, or at least comprise, (but is not limited to) an aluminum material. Further, in some embodiments, as shown particularly in FIGS. 1-2, the hatch seal system 100 may be flush mounted to the hatch opening 6. As such, in the closed position 136, the top surface 131 of the hatch cover 130 and a top surface 116 of the flange portion 120 may be (at least substantially) flush with the water vessel deck 5.

As shown particularly in FIGS. 4-8, the gasket assembly 120 may be disposed about a bottom of the space 118. The gasket assembly 120 may include at least one elongate strip of metal material 121 and a synthetic rubber material 122 surrounding the at least one elongate strip of metal material 121. In some embodiments, the synthetic rubber material 122 may be two part (or twice cured) synthetic rubber. Examples of synthetic rubber material contemplated may include (but is not limited to) EPDM rubber, polychloroprene, styrene-butadiene, silicone, or the like. The synthetic rubber material 122 is shown having texture in FIGS. 4-5 for the sake of clarity only—it should be appreciated that the synthetic rubber material 122 is not limited to having texture. It should also be appreciated that the gasket assembly 120 may not be limited to the synthetic rubber material 122; for example, in some embodiments, natural rubber material may be used. Further, the elongate strip of metal material 121 is shown via broken lines in FIG. 4 for clarity and to aid in understanding that the elongate strip of metal 121 is located underneath the synthetic rubber material 122.

As above, the frame 110 (or frame rail) may be one continuous piece having rounded corners; as such, in this embodiment, the at least one elongate strip of metal material 121 may include one continuous strip of metal material extending an entirety of the frame 110. In other embodiments, the at least one elongate strip of metal material 121 may include four strips of metal material; one for each side of the frame 110. It should however be appreciated that the at least one elongate strip of metal material 121 is not limited to any amounts discussed here.

Figure 6:
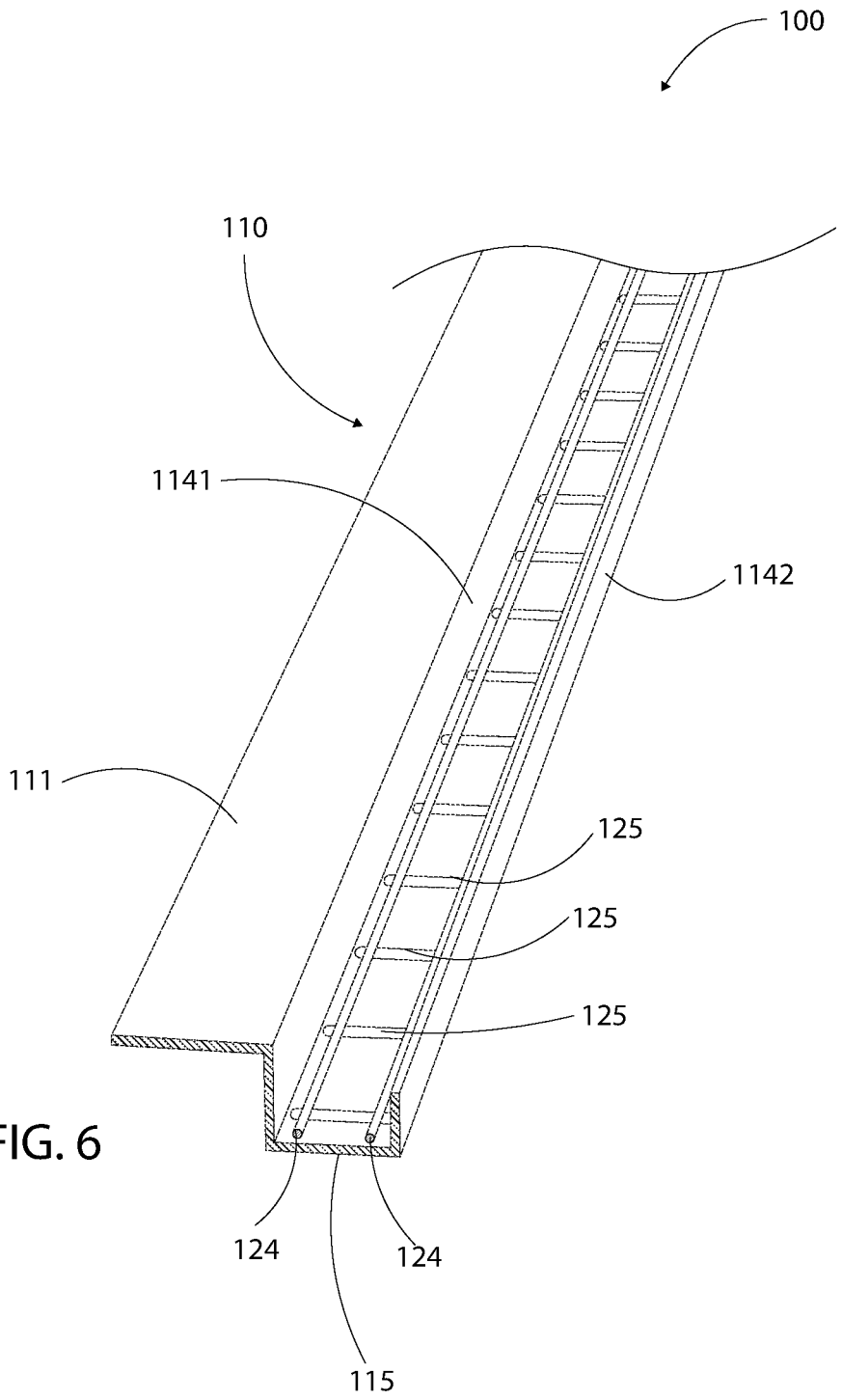
FIG. 6 is a cross-sectional front perspective close-up view of the hatch seal system of FIG. 5 with the synthetic rubber material removed for clarity and illustrating the elongate strip of metal material, according to an embodiment of the present disclosure.

The synthetic rubber material 122 is removed from FIG. 6 to aid in clarity and enable clear illustration, and thus understanding, of the at least one elongate strip of metal material 121. As shown, in some embodiments, the at least one elongate strip of metal material 121 may include a strip of wire mesh 123. Particularly, the at least one elongate strip of metal material 121 may include a pair of side members 124 and a plurality of lateral members 125. The pair of side members 124 may, as shown in FIG. 6 particularly, include thin wires located parallel each other. In some embodiments, the pair of side members 124 may include (but are not limited to) a width, or diameter, of 1/16 inches.

As shown in FIG. 6, the plurality of lateral members 125 may be attached between the pair of side members 124 and spaced equally apart along a length thereof. The plurality of lateral members 125 may also include thin wires. In some embodiments, the plurality of lateral members 125 may include (but are not limited to) a width of ¾ inch. Preferably, as shown, the plurality of lateral members 125 may be attached to a bottom side, or an underside, of the pair of side members 124.

Figure 7:
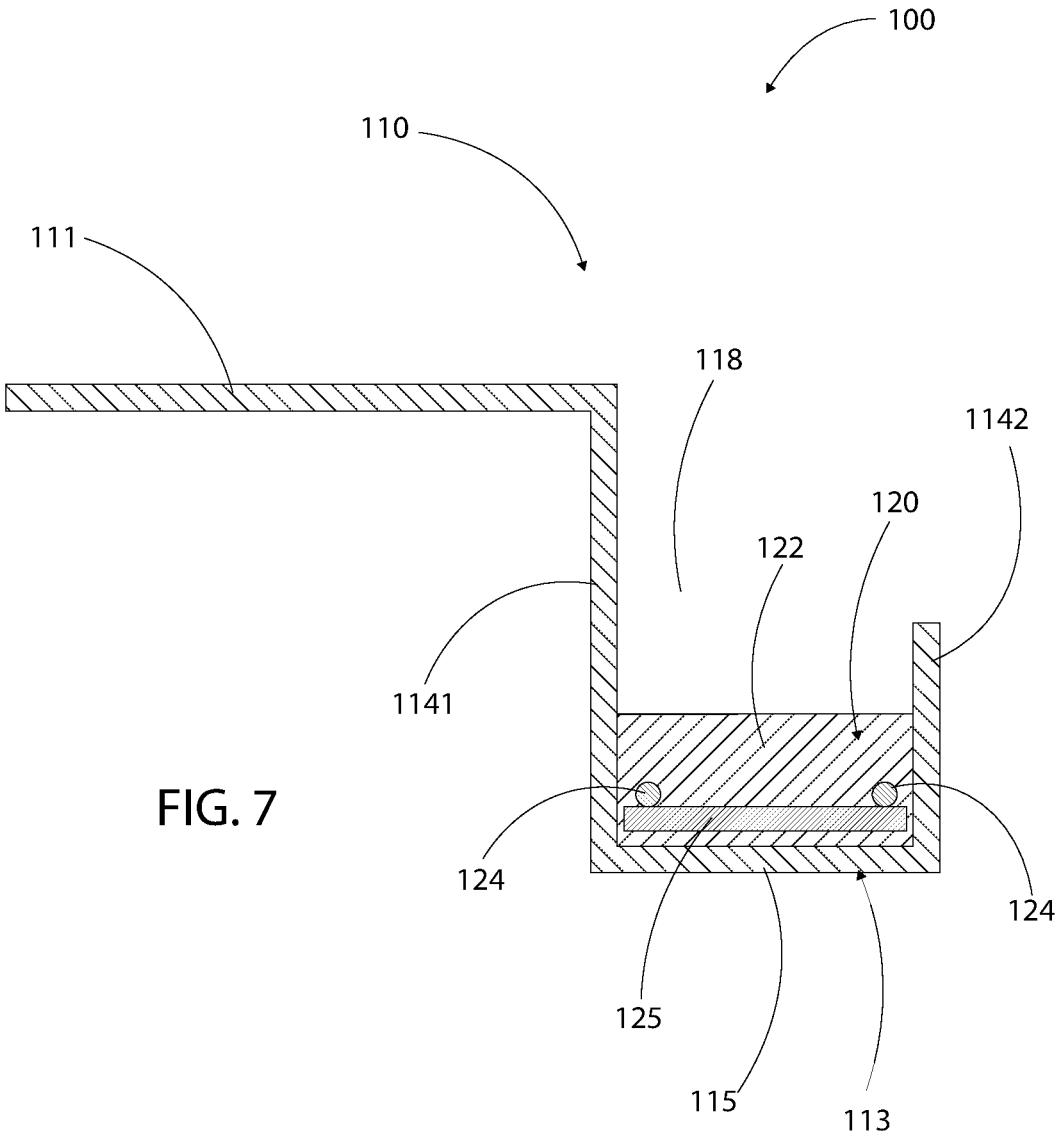
FIG. 7 is a cross-sectional front view of the hatch seal system of FIG. 5 again taken from line 5-5 in FIG. 4, according to an embodiment of the present disclosure.
Figure 8:
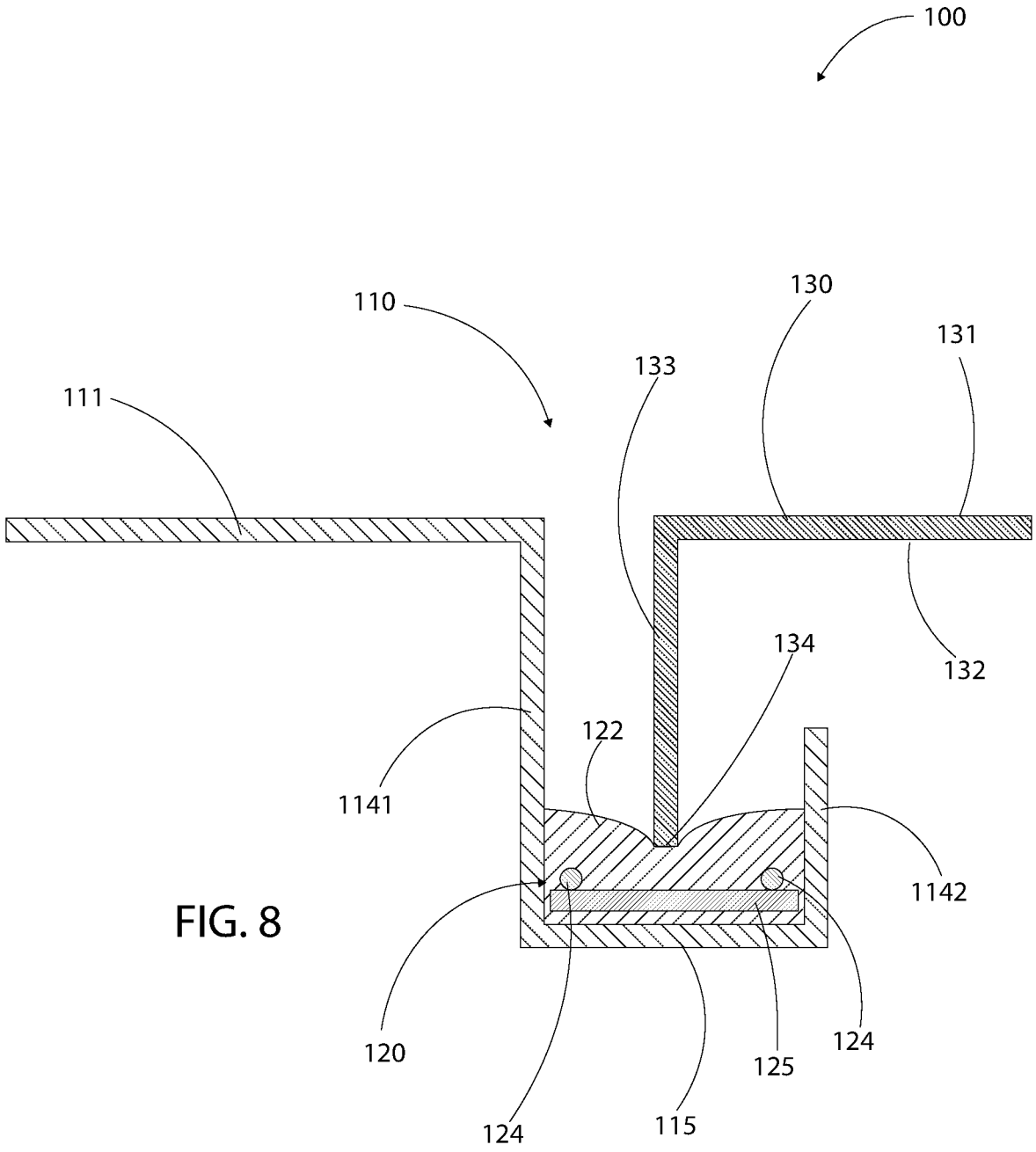
FIG. 8 is a cross-sectional front view of the hatch seal system taken from line 7-7 in FIG. 3 and illustrating the hatch cover being inserted into the synthetic rubber material and forming a watertight seal with the frame, according to an embodiment of the present disclosure.

As above, the gasket assembly 120 may be disposed about the bottom of the space 118. Particularly, as shown in FIGS. 6-8, the at least one elongate strip of metal material 121 may be attached to the cross-panel 115. Preferably, the at least one elongate strip of metal material 121 may be welded to the cross-panel 115, to create a durable connection between the gasket assembly 120 and the frame 110. As shown in FIGS. 7-8, the synthetic rubber material 122 may completely surround the at least one elongate strip of metal material 121.

As shown particularly in FIG. 8, in the closed position 136 (wherein the hatch cover 130 is covering the hatch opening 6 and is latched to the frame 110), the hatch cover 130 may seal to the frame 110 via the peripheral lip 133. Particularly, the peripheral lip 133 may be inserted into the space 118 when in the closed position 136, and an edge 134 of the peripheral lip 133 may be pressed into the synthetic rubber material 122 (not penetrating the synthetic rubber material 122). This may cause the synthetic rubber material 122 to surround the edge 134 of the peripheral lip 133, as shown in FIG. 8, and thereby create a watertight seal for the hatch opening 6 (between the frame 110 and the hatch cover 130).

To aid in this, an indent 126 (FIG. 5) may be pressed into the synthetic rubber material 122 by the edge 134 prior to installation of the hatch seal system 100 to the water vessel deck 5. For example, after initial cure of the synthetic rubber material 122 (when placed atop the elongate strip of metal material 121), the hatch cover 130 may be placed into the closed position 136 and latched, the edge 134 of the peripheral lip 133 may press into the synthetic rubber material 122, and during subsequent/additional curing of the synthetic rubber material 122, the indent 126 may be cured into the synthetic rubber material 122.

As shown in FIGS. 7-8, the synthetic rubber material 122 may fill at least a third of the space 118. This may ensure that the edge 134 of the peripheral lip 133 is adequately pressed into the synthetic rubber material 122, allowing the synthetic rubber material 122 to sufficiently surround the edge 134 of the peripheral lip 133 and create a watertight seal.

Figure 13:
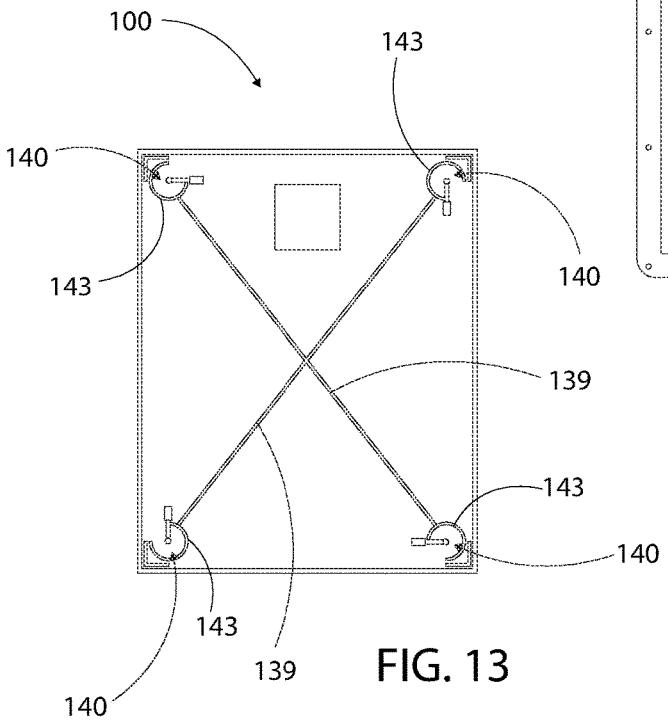
FIG. 13 is a bottom view of the hatch cover, according to an embodiment of the present disclosure.
Figure 15:
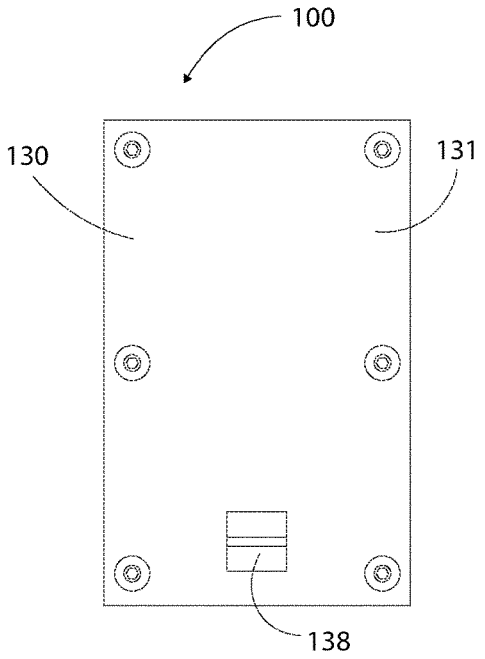
FIG. 15 is a top view of the hatch cover, according to another embodiment of the present disclosure.
Figure 16:
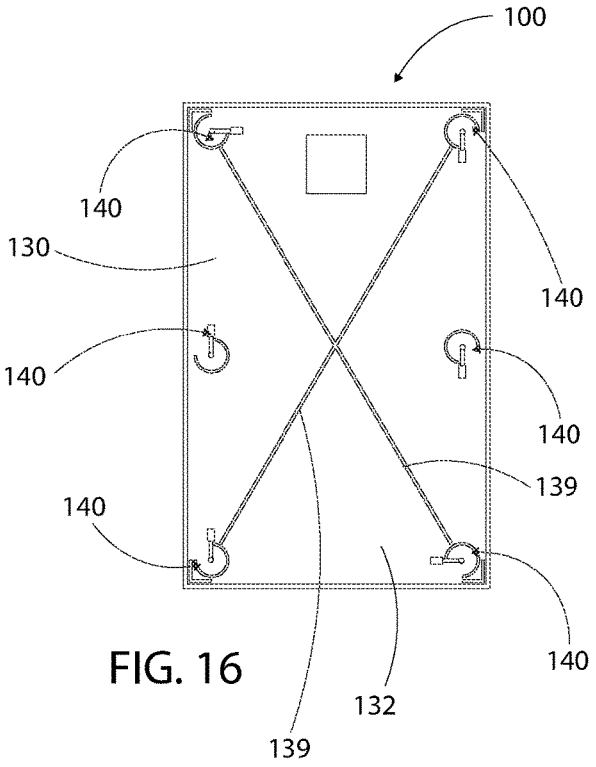
FIG. 16 is a bottom view of the hatch cover, according to another embodiment of the present disclosure.
Figure 17:
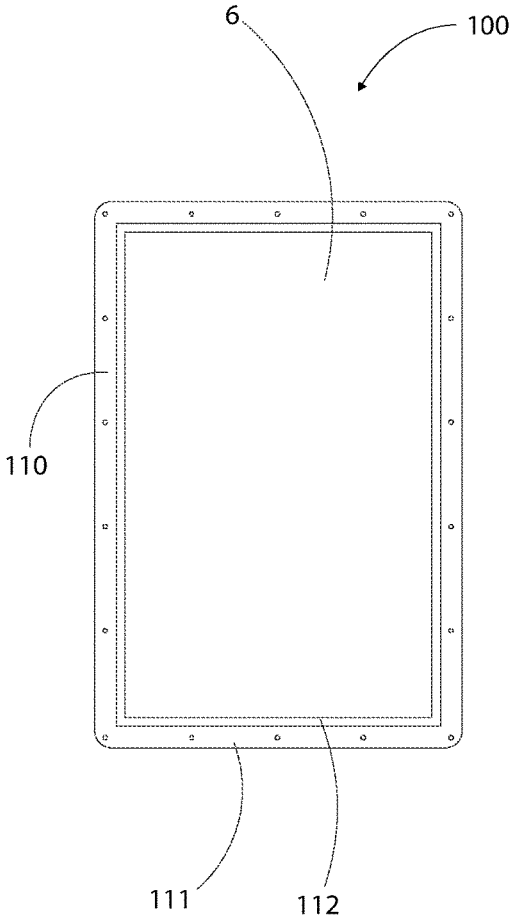
FIG. 17 is a top view of the frame and the hatch opening, according to another embodiment of the present disclosure.
Figure 18:
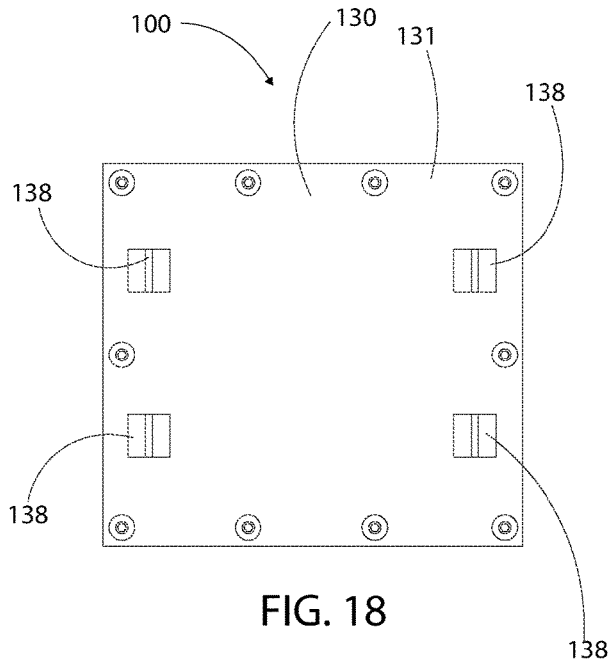
FIG. 18 is a top view of the hatch cover, according to another embodiment of the present disclosure.
Figure 20:
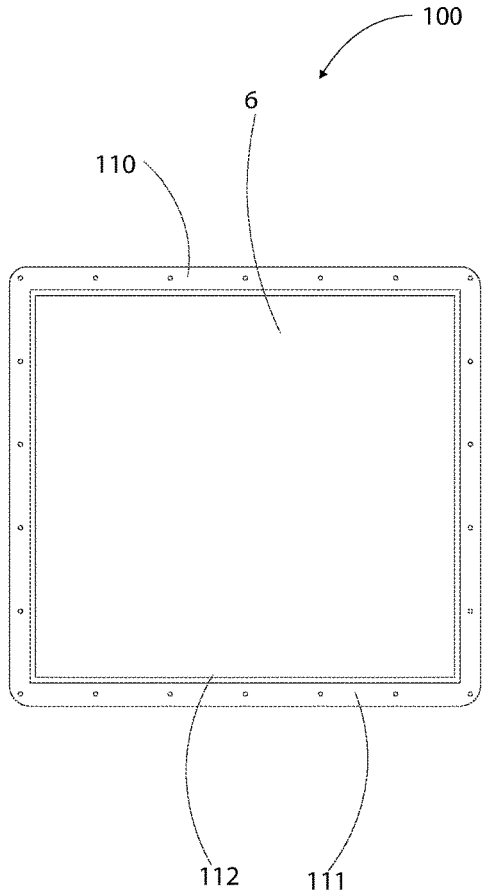
FIG. 20 is a top view of the frame and the hatch opening, according to another embodiment of the present disclosure.
Figure 19:
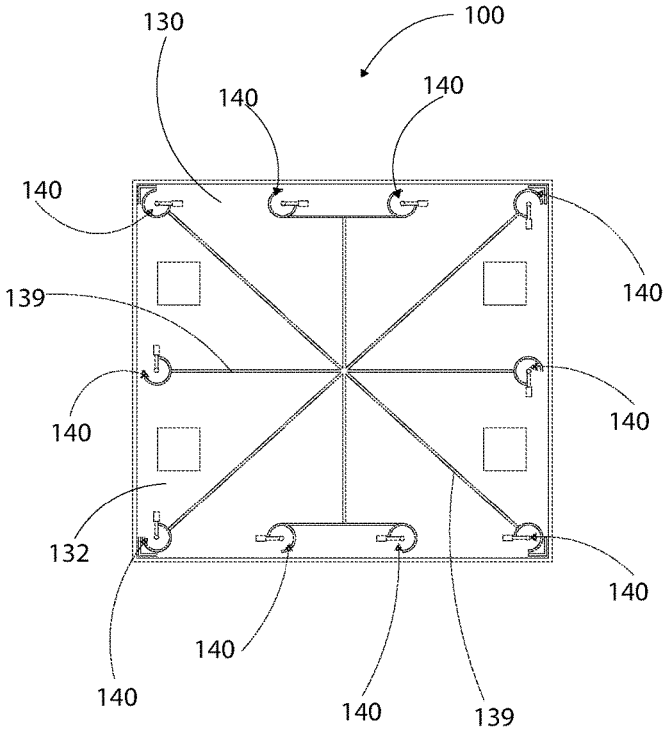
FIG. 19 is a bottom view of the hatch cover, according to another embodiment of the present disclosure.

To keep the hatch cover 130 in the closed position 136, at least one latch mechanism 140 may also be provided and configured to lock the hatch cover 130 in the closed position 136. Particularly, as shown in FIGS. 9-20, the at least one latch mechanism 140 may include a plurality of latch mechanisms 140 disposed about a bottom surface 132 of the hatch cover 130. As shown particularly in FIGS. 9-11, each of the plurality of latch mechanisms 140 may include a rotating shaft 141 configured for insertion (perpendicular to the top surface 131) through an aperture 137 disposed within the hatch cover 130 a latch arm 142 extending from a bottom end of the rotating shaft 141 and at least substantially perpendicular thereto, and in some embodiments, an arcuate seat 143 (FIG. 13).

Figure 9:
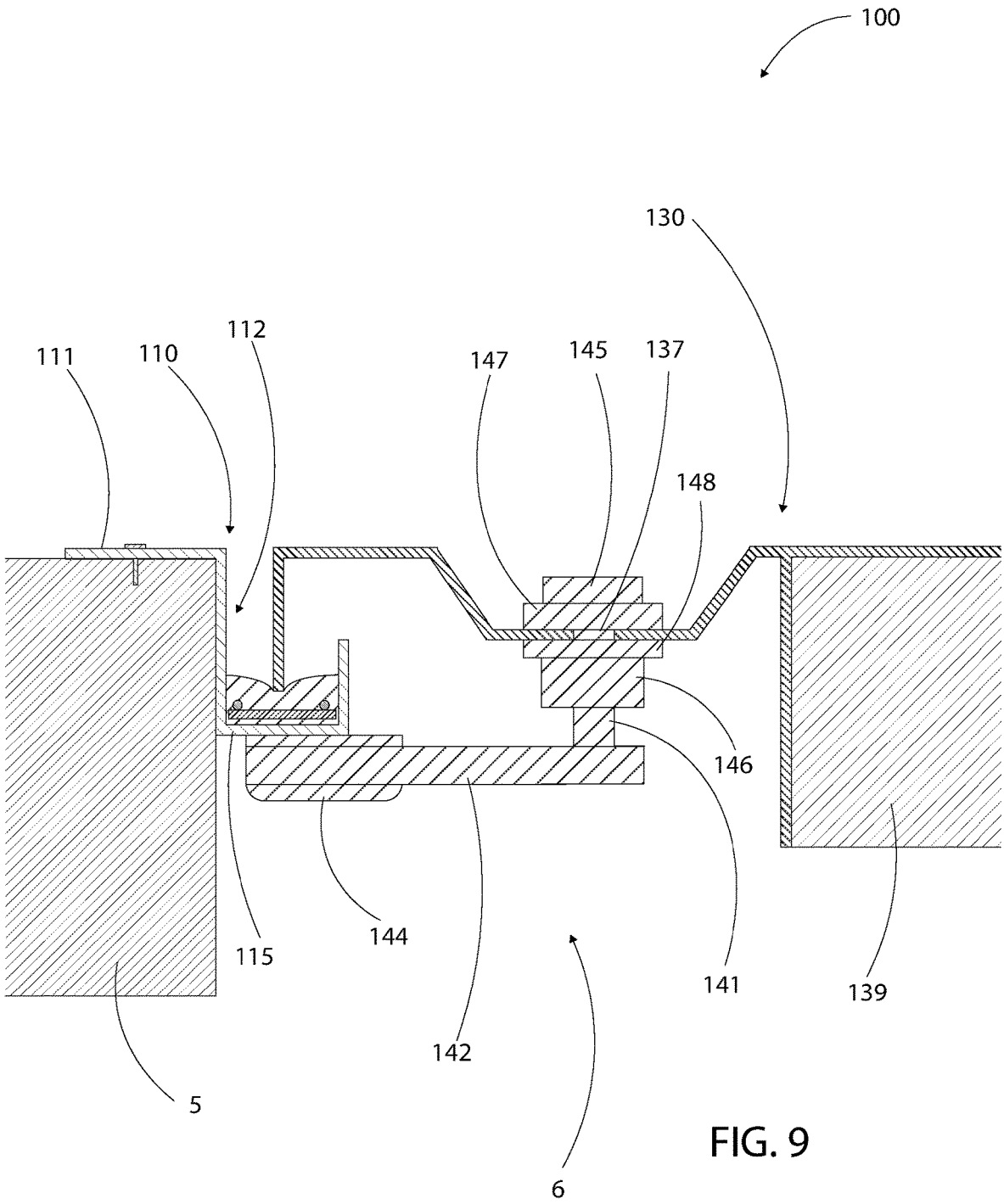
FIG. 9 is a cross-sectional front view of the hatch seal system taken along line 6-6 in FIG. 1, according to an embodiment of the present disclosure.
Figure 10:
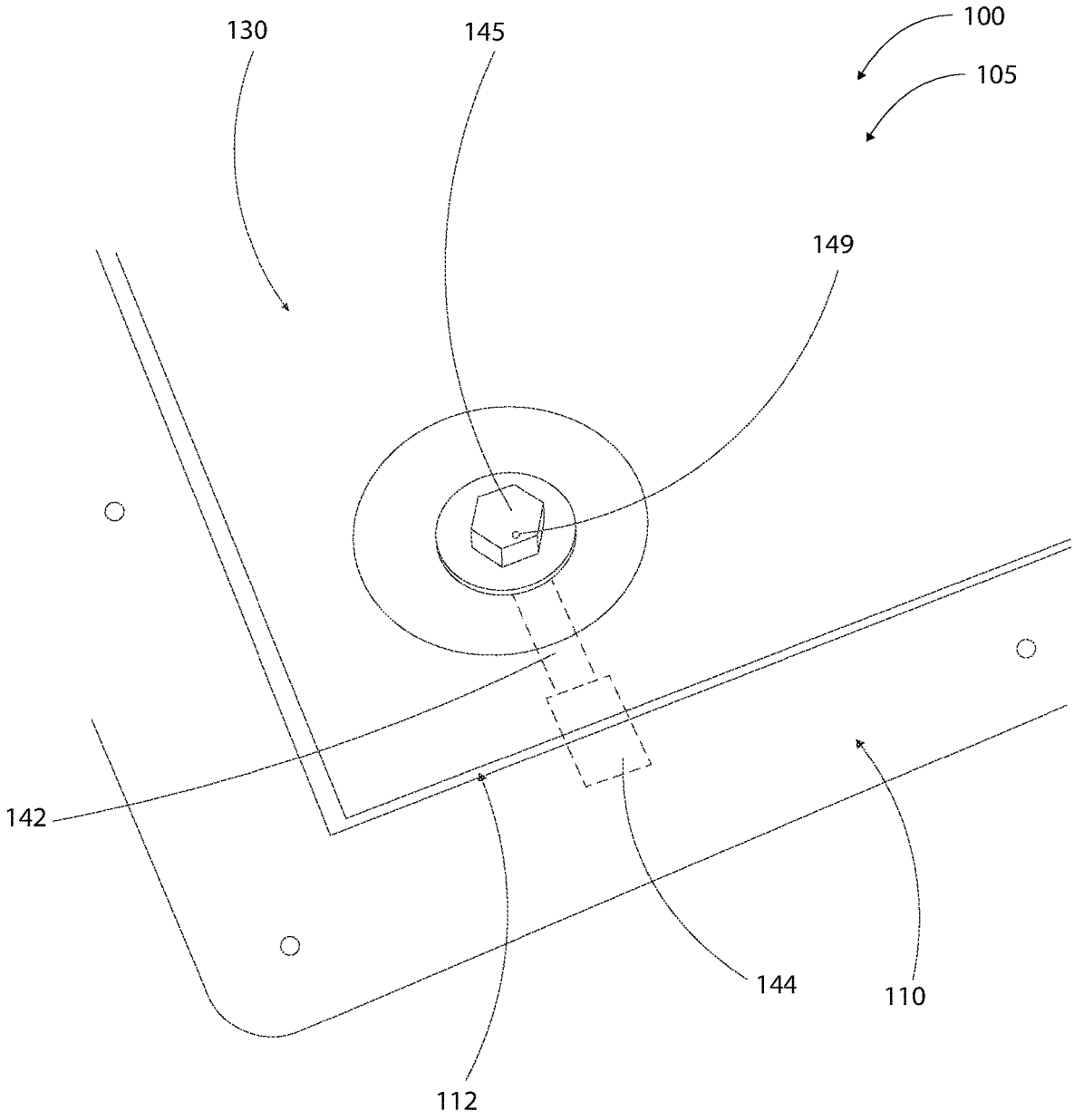
FIG. 10 is a close-up view of the hatch seal system illustrating at least one latch mechanism in a latched position, according to an embodiment of the present disclosure.
Figure 11:
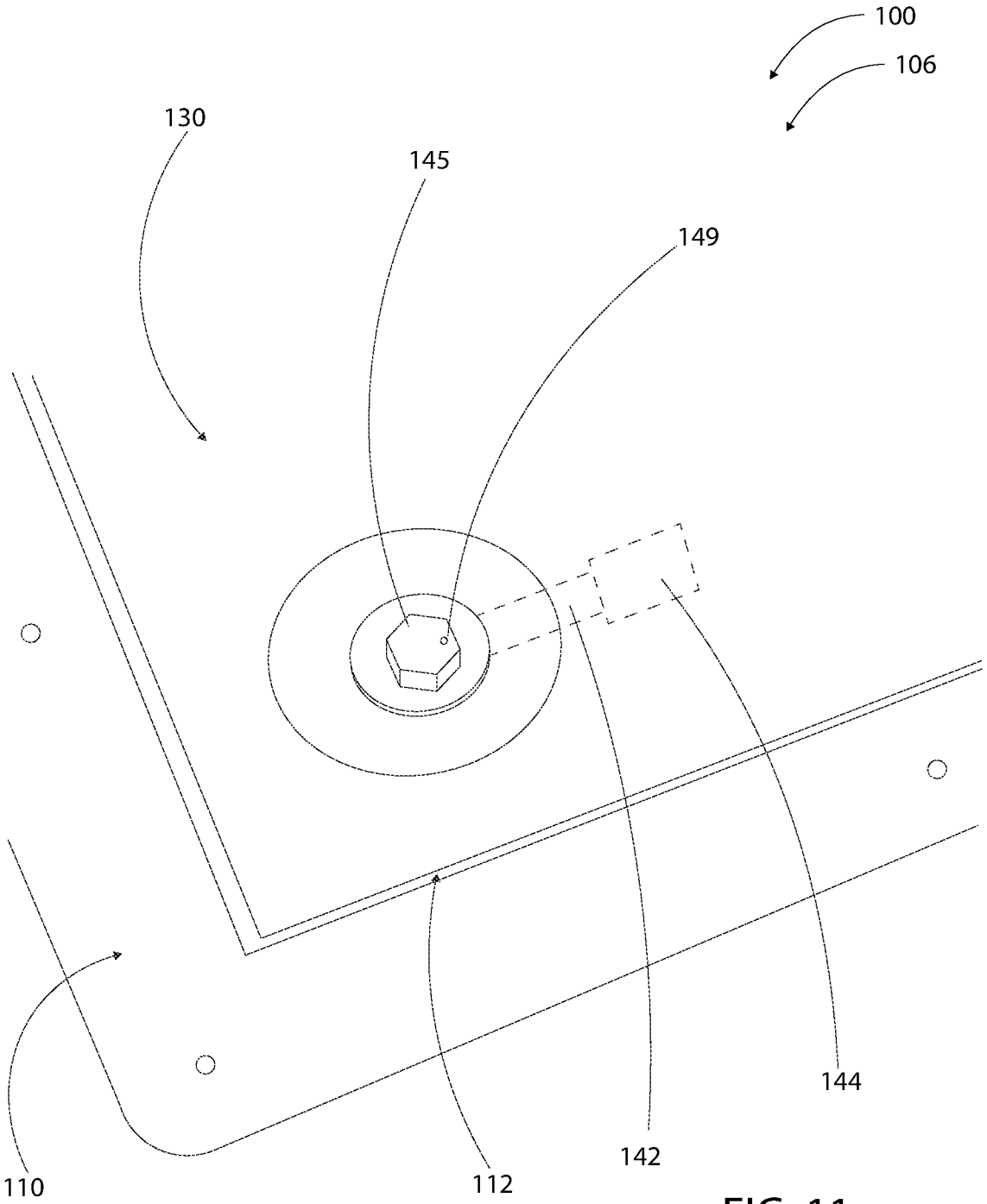
FIG. 11 is a close-up view is of the hatch seal system illustrating at least one latch mechanism in an unlatched position, according to an embodiment of the present disclosure.
Figure 12:
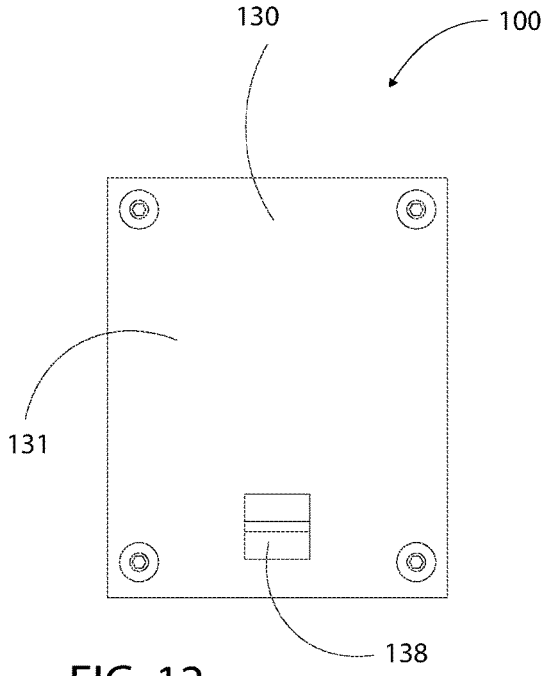
FIG. 12 is a top view of the hatch cover, according to an embodiment of the present disclosure.
Figure 14:
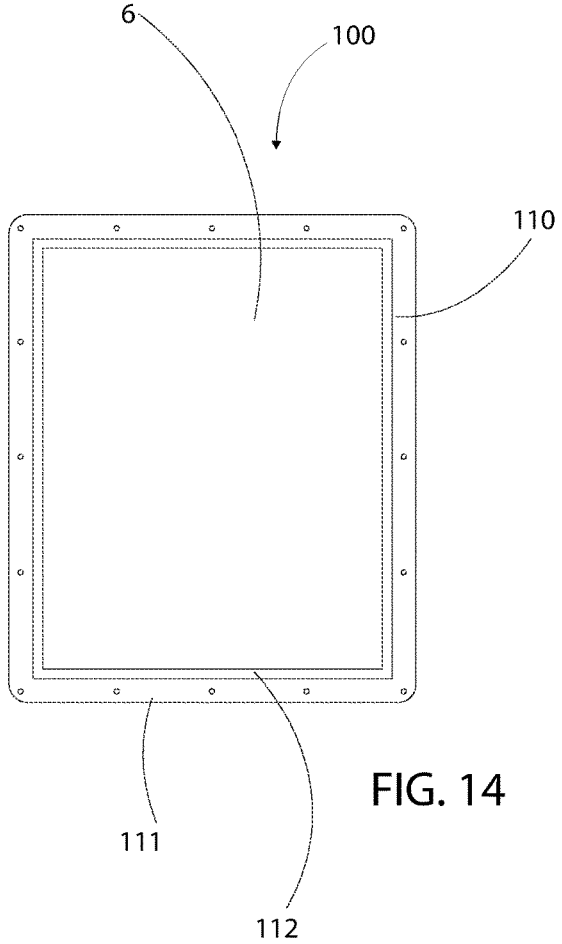
FIG. 14 is a top view of the frame and a hatch opening, according to an embodiment of the present disclosure.

The rotating shaft 141 may be configured to rotate and in doing so, may move the latch arm 142 between a latched position 105 and an unlatched position 106. As shown in FIGS. 9-11, the latch arm 142 may include a stopper 144 located at a distal end thereof. The latch arm 142 and the stopper 144 are illustrated via broken lines in FIGS. 10-11 for clarity. When in the latched position 105, as shown in FIG. 10, the stopper 144 may be located directly underneath the cover receiving portion 112 (or more specifically the cross panel 115) thereby preventing the hatch cover 130 from being moved into the open position 135.

To move the latch arm 142, as shown in FIGS. 9-11, the rotating shaft 141 may include a handle means 145 which enables the user to rotate the rotating shaft 141, and thus move the latch arm 142 between the latched position 105 and the unlatched position 106. In some examples, the rotating shaft 141 may be a threaded bolt. In this example, the handle means 145 may be a bolt head. As such, the user may utilize a ratchet, wrench, etc. to grasp the bolt head and move the latch arm 142 between the latched position 105 and the unlatched position 106. As shown in FIGS. 10-11 particularly, in some embodiments, the bolt head (or other handle means 145) may include a protuberance 149 located on a top surface thereof. The protuberance 149 may indicate whether the at least one latch mechanism 140 is in the latched position 105 or the unlatched position 106. For example, as shown in FIG. 10, in the latched position 105, the protuberance 149 may be nearest the frame 110; as shown in FIG. 11, in the unlatched position 106, the protuberance 149 may be away from the frame 110. To aid in determining position of the at least one latch mechanism 140, the protuberance 149 may include a color, such as a red color, enabling the user to quickly view the protuberance 149 and establish the position of the at least one latch mechanism 140.

Further, in this example, as shown particularly in FIG. 9, the latch mechanism 140 may further include a nut 146, at least one first washer 147 and at least one second washer 148. The aperture 137 may be recessed into the top surface 131 of the hatch cover 130. This may ensure that the bolt head sits at least flush or lower than the top surface 131 of the hatch cover 130 (and thus the water vessel deck 5). The at least one first washer 147 may be placed into the recess at the top surface 131 atop and bordering the aperture 137 and the at least one second washer 148 may be placed at the bottom surface 132 below the aperture 137. The nut 146 may screwed onto the threaded bolt and tightened to the bottom surface 132 of the hatch cover 130 abutting the at least one second washer 148.

As above, the hatch seal system 100 may preferably be mounted flush to the water vessel deck 5. Due to this, it is contemplated that the hatch cover 130 may be walked on, stood on, have items placed thereon, etc. and as such, should be able to withstand heavy forces being placed thereon. As such, as shown in FIG. 2 and FIG. 9, FIG. 13, FIG. 16, and FIG. 19 the hatch cover 130 may further include a plurality of support beams 139 attached to the bottom surface 132 thereof. The plurality of supports beams 139 may provide support and also stiffen, or provide rigidity, to the hatch cover 130, preventing bending thereof. This may be particularly important in embodiments where the hatch cover 130 is made from a lightweight material, such as aluminum.

As shown in FIGS. 12-20, the hatch seal system 100 may be provided in a variety of sizes and/or shapes to accommodate a variety of hatch opening 6 sizes and shapes. Each size/shape of the hatch seal system 100 may include all features discussed above; however, an amount of particular elements may be adjusted. For example, as demonstrated in FIGS. 12-14, a smaller sized hatch seal system 100 may include (but is not limited to) four latch mechanisms 140 and one handle 138; whereas a larger sized hatch seal system 100, as demonstrated in FIGS. 18-20, may include (but is not limited to) ten latch mechanisms 140 and four handles 138.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A hatch seal system for a hatch opening in a water vessel deck, the hatch seal system comprising:

a frame configured to install into and border the hatch opening, the frame including a flange portion and a cover receiving portion, the flange portion contacting the water vessel deck when installed and extending substantially parallel thereto, the cover receiving portion extending downwardly from the flange portion into the hatch opening when installed and substantially perpendicular to the water vessel deck, the cover receiving portion including a space;

a gasket assembly disposed about a bottom of the space, the gasket assembly including at least one elongate strip of metal material and a synthetic rubber material surrounding the at least one elongate strip of metal material; and a hatch cover configured to selectively cover the hatch opening, the hatch cover including a top surface opposite a bottom surface and a peripheral lip extending downwardly from the top surface and substantially perpendicular to the top surface and the water vessel deck, the hatch cover being movably attached to the frame such that the hatch cover is movable between a closed position and an open position, the closed position covering the hatch opening; and wherein the peripheral lip is inserted into the space when in the closed position and an edge of the peripheral lip is pressed into the synthetic rubber material, causing the synthetic rubber material to surround the edge of the peripheral lip, thereby creating a watertight seal for the hatch opening.

2. The hatch seal system of claim 1, further comprising at least one latch mechanism attached to the hatch cover, the at least one latch mechanism configured to lock the hatch cover in the closed position.

3. The hatch seal system of claim 2, wherein the at least one latch mechanism includes a rotating shaft, a latch arm and a stopper attached to a distal end of the latch arm, the rotating shaft configured for insertion into an aperture of the hatch cover, the latch arm extending at least substantially perpendicular to a bottom end of the rotating shaft and configured for movement between a latched position and an unlatched position, the latched position including the stopper being located directly underneath the cover receiving portion, thereby preventing the hatch cover from being moved into the open position.

4. The hatch seal system of claim 1, wherein the at least one elongate strip of metal material includes a strip of wire mesh.

5. The hatch seal system of claim 4, wherein the at least one elongate strip of metal material includes a pair of side members and a plurality of lateral members attached between the pair of side members and spaced equally apart along a length thereof.

6. The hatch seal system of claim 5, wherein the plurality of lateral members are attached to a bottom side of the pair of side members.

7. The hatch seal system of claim 6, wherein the pair of side members each include a width of 1/16 inch and wherein the plurality of lateral members each include a width of 3/4 inch.

8. The hatch seal system of claim 1, wherein the at least one elongate strip of metal material is welded to the cross-panel.

9. The hatch seal system of claim 8, wherein the synthetic rubber material fills at least a third of the space.

10. The hatch seal system of claim 9, wherein the cover receiving portion includes a generally U-shaped cross-section.

11. The hatch seal system of claim 10, wherein the cover receiving portion includes a pair of side panels and a cross-panel attached therebetween, a first side panel of the pair of side panels may be attached to and extending downwardly and perpendicular to the flange portion, the cross-panel attached to and extending substantially perpendicular to the first side panel, and a second side panel of the pair of side panels attached to and extending upwardly and perpendicular to the cross-panel, and wherein the space is defined between the pair of side panels and the cross-panel defines the bottom of the space.

12. The hatch seal system of claim 11, wherein the hatch cover is made from an aluminum material.

13. The hatch seal system of claim 12, wherein the frame is made from a stainless steel material.

14. The hatch seal system of claim 13, wherein in the closed position the top surface of the hatch cover and a top surface of the flange portion are at least substantially flush with the water vessel deck.

15. A hatch seal system for a hatch opening in a water vessel deck, the hatch seal system comprising:

a frame configured to install into and border the hatch opening, the frame including a flange portion and a cover receiving portion, the flange portion contacting the water vessel deck when installed and extending substantially parallel thereto, the cover receiving portion extending downwardly from the flange portion into the hatch opening when installed and substantially perpendicular to the water vessel deck, the cover receiving portion including a generally U-shaped cross-section having a pair of side panels and a cross-panel attached therebetween, a first side panel from the pair of side panels being attached to and extending downwardly and perpendicular to the flange portion, the cross-panel attached to and extending substantially perpendicular to the first side panel, and a second side panel from the pair of side panels attached to and extending upwardly and perpendicular to the cross-panel, the pair of side panels including a space therebetween and the cross-panel defining a bottom of the space;

a gasket assembly disposed about the bottom of the space, the gasket assembly including at least one strip of wire mesh attached to the cross-panel and a synthetic rubber material surrounding the at least one strip of wire mesh, the at least one strip of wire mesh including a pair of side members and a plurality of lateral members attached between the pair of side members and spaced equally apart along a length thereof, the plurality of lateral members attached to a bottom side of the pair of side members; and a hatch cover configured to selectively cover the hatch opening, the hatch cover including a top surface opposite a bottom surface and a peripheral lip extending downwardly from the top surface and substantially perpendicular to the top surface and the water vessel deck, the hatch cover being movably attached to the frame such that the hatch cover is movable between a closed position and an open position, the closed position covering the hatch opening;

at least one latch mechanism attached to the hatch cover and configured to lock the hatch cover in the closed position, the at least one latch mechanism including a rotating shaft, a latch arm and a stopper attached to a distal end of the latch arm, the rotating shaft configured for insertion into an aperture of the hatch cover, the latch arm extending at least substantially perpendicular to a bottom end of the rotating shaft and configured for movement between a latched position and an unlatched position, the latched position including the stopper being located directly underneath the cover receiving portion, thereby preventing the hatch cover from being moved into the open position;

wherein the peripheral lip is inserted into the space when in the closed position and an edge of the peripheral lip is pressed into the synthetic rubber material, causing the synthetic rubber material to surround the edge of the peripheral lip, and thereby creating a watertight seal for the hatch opening; and wherein in the closed position the top surface of the hatch cover and a top surface of the flange portion are at least substantially flush with the water vessel deck.

16. The hatch seal system of claim 15, wherein the at least one elongate strip of metal material is welded to the cross-panel.

17. The hatch seal system of claim 16, wherein the synthetic rubber material fills at least a third of the space.

18. The hatch seal system of claim 17, wherein the hatch cover is made from an aluminum material.

19. The hatch seal system of claim 18, wherein the frame is made from a stainless steel material.

20. A hatch seal system for a hatch opening in a water vessel deck, the hatch seal system comprising:

a frame configured to install into and border the hatch opening, the frame made from a stainless steel material, the frame including a flange portion and a cover receiving portion, the flange portion contacting the water vessel deck when installed and extending substantially parallel thereto, the cover receiving portion extending downwardly from the flange portion into the hatch opening when installed and substantially perpendicular to the water vessel deck, the cover receiving portion including a generally U-shaped cross-section having a pair of side panels and a cross-panel attached therebetween, a first side panel from the pair of side panels attached to and extending downwardly and perpendicular to the flange portion, the cross-panel attached to and extending substantially perpendicular to the first side panel, and a second side panel from the pair of side panels attached to and extending upwardly and perpendicular to the cross-panel, the pair of side panels including a space therebetween and the cross-panel defining a bottom of the space;

a gasket assembly attached to the cross-panel, the gasket assembly including at least one strip of wire mesh welded to the cross-panel and a synthetic rubber material surrounding the at least one strip of wire mesh, the synthetic rubber filling at least a third of the space, the at least one strip of wire mesh including a pair of side members and a plurality of lateral members attached between the pair of side members and spaced equally apart along a length thereof, the plurality of lateral members attached to a bottom side of the pair of side members; and a hatch cover configured to selectively cover the hatch opening, the hatch cover made from an aluminum material, the hatch cover including a top surface opposite a bottom surface and a peripheral lip extending downwardly from the top surface and substantially perpendicular to the top surface and the water vessel deck, the hatch cover being movably attached to the frame such that the hatch cover is movable between a closed position and an open position, the closed position covering the hatch opening;

at least one latch mechanism attached to the hatch cover and configured to lock the hatch cover in the closed position, the at least one latch mechanism including a rotating shaft, a latch arm and a stopper attached to a distal end of the latch arm, the rotating shaft configured for insertion into an aperture of the hatch cover, the latch arm extending at least substantially perpendicular to a bottom end of the rotating shaft and configured for movement between a latched position and an unlatched position, the latched position including the stopper being located directly underneath the cover receiving portion, thereby preventing the hatch cover from being moved into the open position;

wherein the peripheral lip is inserted into the space when in the closed position and an edge of the peripheral lip is pressed into the synthetic rubber material, causing the synthetic rubber material to surround the edge of the peripheral lip and thereby creating a watertight seal for the hatch opening; and wherein in the closed position the top surface of the hatch cover and a top surface of the flange portion are at least substantially flush with the water vessel deck.

* * * * *